United States Patent [19]

Haas

[11] 3,933,544

[45] Jan. 20, 1976

[54] METHOD OF ETCHING COPPER AND COPPER ALLOYS

[75] Inventor: Rainer Haas, Magstadt, Germany

[73] Assignee: Firma Hans Hollmuller, Maschinenbau, Herrenberg, Germany

[22] Filed: Aug. 6, 1973

[21] Appl. No.: 386,021

Related U.S. Application Data

[62] Division of Ser. No. 230,871, March 1, 1972, Pat. No. 3,806,393.

[30] Foreign Application Priority Data

| | | |
|---|---|---|
| Mar. 8, 1971 | Germany | 2110950 |
| Aug. 11, 1971 | Germany | 2140215 |
| Jan. 21, 1972 | Switzerland | 1025/72 |

[52] U.S. Cl. ..... 156/19; 156/345

[51] Int. Cl.[2] ..... C23F 1/00

[58] Field of Search ..... 252/79.1–79.5; 156/3, 8, 18, 19; 134/10

[56] References Cited

UNITED STATES PATENTS

| | | | |
|---|---|---|---|
| 3,216,873 | 11/1965 | Jones | 156/14 |
| 3,466,208 | 9/1969 | Slominski | 156/18 |
| 3,505,135 | 4/1970 | Lindstrom | 156/19 |
| 3,717,521 | 2/1973 | Slominski et al. | 156/19 |

*Primary Examiner*—William A. Powell
*Attorney, Agent, or Firm*—Karl F. Ross; Herbert Dubno

[57] ABSTRACT

A method of etching copper and copper alloys by means of an ammoniacal etching solution containing chloride ions and for regenerating this etching solution during this etching process by adding an ammoniacal compound, for example, in the form of ammonium hydroxide or ammonia gas, as well as hydrochloric acid and water to the etching solution in accordance with continuous measurements of the pH-value and the specific gravity of the etching solution.

3 Claims, 9 Drawing Figures

METHOD OF ETCHING COPPER AND COPPER ALLOYS

This is a division of application Ser. No. 230,871, filed 1 Mar. 1972, now U.S. Pat. No. 3,806,393 issued 23 April 1974.

The present invention relates to a method of etching copper and copper alloys and especially copper-coated conductor plates by means of an etching medium in the form of an ammoniacal etching solution which contains chloride ions.

Since acid etching media cannot be employed for all etching resists and especially not for so-called etching reserves such as, for example, lead-tin alloys, tin, pure tin, nickel and even gold, various alkaline etching media have been developed which, however, can be utilized only until their cooper content reaches a certain value and must thereafter be discarded and newly prepared.

It is an object of the present invention to provide a method in which the etching medium employed only needs to be prepared once and is thereafter continuously regenerated so as to retain its full etching power as long as may be desired.

For attaining this object, the invention provides that for the regeneration of the copper-I compound which is formed during the etching process a chlorine-containing compound such as, for example, HCl, ammonium chloride, NaCl or the like is employed and that in addition to the chlorine-containing compound an amount of an ammoniacal compound such as, for example, ammonium hydroxide or ammonia gas is added to the etching medium which is to be regenerated as may be required for again providing this medium with a pH-value of about 8.5 to 10.0.

If in this method an ammoniacal etching solution is employed which contains chloride ions and may be produced, for example, of water, ammonium chloride and ammonium hydroxide and preferably has a pH-value of 9.2, and if this etching solution is used for etching copper, a tetramine complex will result which the following composition:

$$Cu(NH_3)_4 Cl_2.$$

If all chloride and ammonium ions of the etching solution have reacted in this manner, the further etching process will occur in accordance with the following formula:

$$Cu(NH_3)_4 Cl_2 + Cu^{o} \rightarrow 2\ Cu(NH_3)_2 Cl.$$

A diamine complex is thus formed which no longer has any etching effect so that a regeneration will now be required by the addition of a chloride compound and an ammoniacal compound.

In this regeneration, the following process occurs:

$$2\ Cu(NH_3)_2 Cl + 2\ HCl + 4\ NH_4 OH \rightarrow 2\ Cu(NH_3)_4 Cl_2 + 4\ H_2O.$$

By the addition of hydrochloric acid and also of ammonium hydroxide it is therefore possible to regenerate the etching medium in such a manner that it will again correspond to the etching medium as originally prepared. This requires for each mol of copper the addition of 2 mols of hydrochloric acid or of 4mols of $NH_4OH$.

For attaining uniform etching results, it is further of advantage to maintain the copper content of the etching medium at a constant value by the addition of a liquid, for example, water. This diluent may be added simultaneously with the addition of the regenerating chemicals the quantity of which is preferably controlled by a specific-gravity measuring device.

The addition of the chloro and ammoniacal compounds to the etching medium to be regenerated may be carried out either as a function of its pH-value, redox potential, specific gravity, or as a function of its change in color, and the molar ratio of the chloride compound to the ammoniacal compound then amounts to 1:2.

It is likewise possible to carry out the addition of the chloro compound in direct relation to the redox potential, the specific gravity or the change in color of the etching medium and to carry out the addition of the ammoniacal compound in direct relation to the pH-value of the etching medium to be regenerated.

This addition of the chloro compound and also of the ammoniacal compound may be carried out either in the etching machine itself or in a separate regenerating apparatus which is connected to the etching machine. Such a regenerating apparatus preferably comprises a reaction container and three supply containers which are located above the reaction container and contain the compounds to be added as well as water and are connected to the reaction container by conduits which are adapted to be opened and closed. The regenerating apparatus further comprises two measuring devices one of which controls the redox potential, the specific gravity or the change in color, and while the other monitors the pH-value and controls the addition of the compounds. These measuring devices project into the reaction container which holds the etching medium. Furthermore, a measuring device is connected to the reaction container which continuously checks the specific gravity of the etching medium and thus also its copper content and controls the addition of water.

If the regenerating media are to be added directly within the etching machine, the conduits for supplying these media are connected directly to the container for the etching medium which forms a part of the etching machine. The regenerating media are then supplied by means of injectors which are located within the circulating line for the etching medium and are connected to the containers of the regenerating media by conduits which are adapted to be opened and closed.

An inventive feature of a very advantageous embodiment of the measuring device as mentioned above consists in providing a float at the inside of a container through which the etching medium which is to be supervised flows continously, and in providing on the lower side of this float a metal body which is operatively associated with an inductive switch which is mounted underneath the container and forms a part of an electric mechanism which controls the supply of water and also forms a part of a mechanism which controls the supply of the chloro compound and possibly also of the ammoniacal compound. According to a very advantageous embodiment of the invention, the mentioned measuring container is provided in the form of a cylinder which has an inlet as well as an outlet for the etching medium to be measured, and the float is provided in the form of a rod the lower end of which carries the metal body which consists of titanium.

Another feature of the invention consists in providing the above-mentioned measuring mechanism with a control mechanism by means of which the control valves for regulating the supply of the diluent and the supply of the ammoniacal compound are preferably alternately actuated in accordance with the pH-value of the etching medium which is to be regenerated. This control mechanism may, however, also be designed so as only to control the operation of the valve which regulates the supply of the ammoniacal compound in accordance with the pH-value of the etching medium.

For measuring, for example, within each measuring container the level of the particular liquid compound which is to be added to the etching medium, it is another feature of the invention to provide a further measuring device which consists of a float which contains an annular magnet and of an electric switch which is operatively associated with this magnet and is mounted within an adjacent liquid-tight housing. According to a preferred embodiment of the invention, this float is located within a separate housing which is connected to the particular container, while the switch which is associated with the float is mounted outside of this housing, preferably above or below the same. This switch may be, for example, a so-called reed switch the switch contacts of which are enclosed within a glass tube which is tightly sealed toward the outside.

These and other features and advantages of the method according to the present invention as well as of several regenerating apparatus for carrying out this method will become further apparent from the following detailed description which is to be read with reference to the accompanying drawing, in which - -

Figure 1:
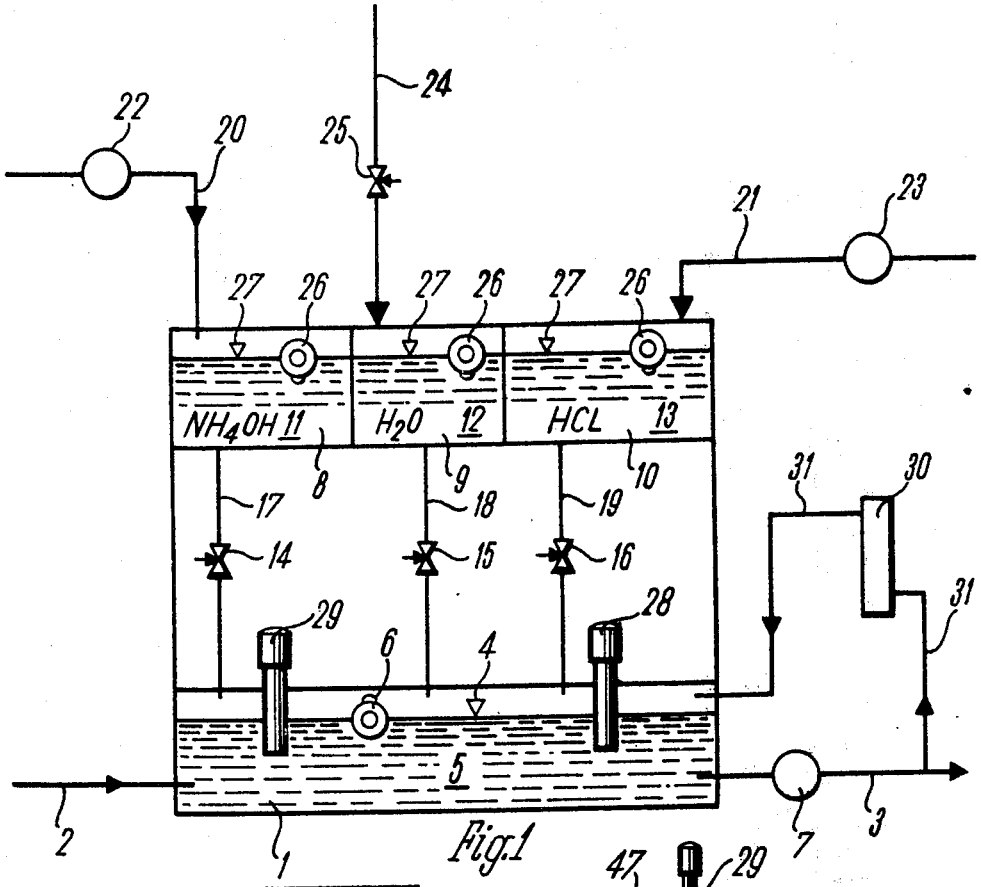
FIG. 1 is a diagrammatic illustration of a regenerating apparatus according to the invention in which the regeneration of the etching medium is carried out by means of $NH_4OH$, HCl and $H_2O$.

Referring first to FIG. 1 of the drawings, the regenerating apparatus according to the invention comprises a reaction container 1 which is connected by an inlet line 2 and an outlet line 3 to an etching machine, not shown. The level 4 of the etching medium 5 which is contained in the reaction container 1 and also in the etching machine is determined either by an overflow, not shown, or by a level-control switch 6 which will be subsequently described in detail. Furthermore, a pump 7 is inserted into the outlet line 3 leading to the etching machine.

Above the reaction container 1, three supply containers 8, 9 and 10 are mounted which respectively contain ammonium hydroxide 11, water 12 and hydrochloric acid 13 as regenerating media. These supply containers 8, 9 and 10 are connected to the reaction container 1 by means of the lines 17, 18 and 19 which may be closed by solenoid valves 14, 15 and 16, respectively. The supply container 8 is connected by a supply line 20 and the supply container 10 by a supply line 21 to a main supply, not shown, of the respective regenerating medium, and into each of these supply lines 20 and 21 a feed pump 22 or 23 is inserted. The central supply container 9, however, is connected directly to the main water supply by a supply line 24 into which likewise a solenoid valve 25 is inserted. The operation of each of the two feed pumps 22 and 23 as well as of the solenoid valve 25 for regulating the water supply is controlled by a level-control switch 26 which is similar to the level-control switch 6 as mentioned above. Each of these control switches 26 effects a replenishment of the respective regenerating liquid or of the water in its container 8 to 10 if the level 27 of the liquid has dropped in this container to a predetermined value.

For controlling the addition of the hydrochloric acid 13 from the container 10 to the etching medium 5, a redox measuring electrode 28 is provided which is responsive to the respective redox potential which the etching medium 5 has at any time in the reaction container 1. As soon as the redox potential drops below certain minimum value, this electrode 28 causes the solenoid valve 16 to be opened so that the required amount of hydrochloric acid 13 will be supplied to the reaction container 1. A further measuring electrode 29 is responsive to the prevailing pH-value of the etching medium 5 and opens the solenoid valve 14 of the container 8 as soon as the pH-value of the etching medium drops below a certain minimum value. As soon as the etching medium 5 has again reached its proper redox potential and also its proper pH-value, the respective solenoid valve 14 or 16 is again closed.

For controlling the operation of the solenoid valve 15 which regulates the supply of water, the apparatus according to the invention is provided with a measuring device 30 which continuously measures the specific gravity of the etching medium 5 and is connected at one end through a branch line 31 to the outlet 3 and at the other end directly to the reaction container 1.

Figure 2:
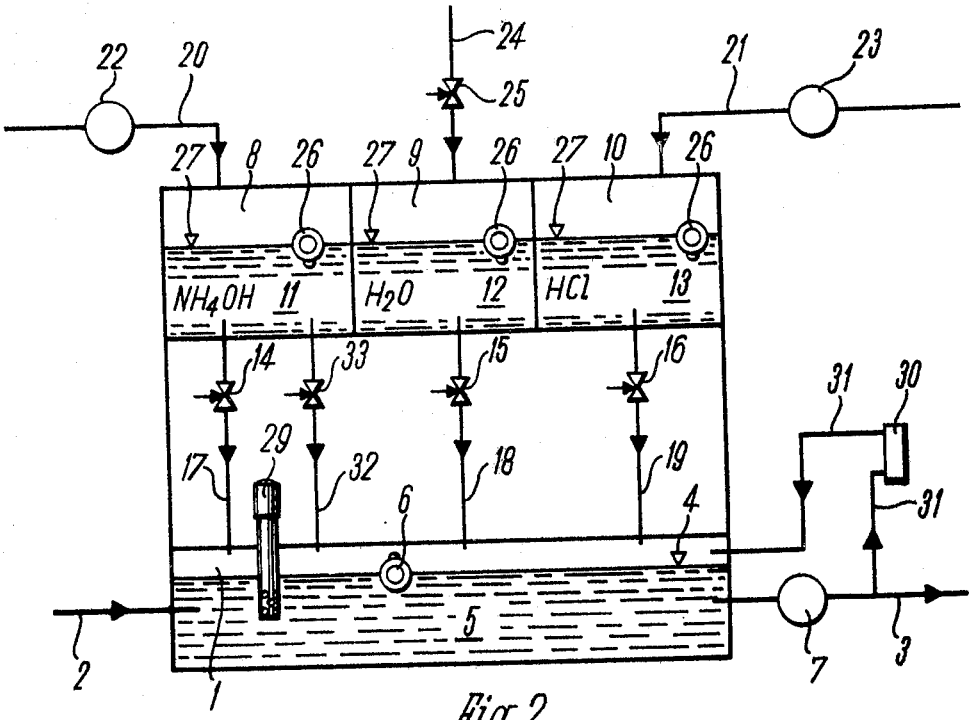
FIG. 2 is a diagrammatic illustration of a modification of the regenerating apparatus as shown in FIG. 1.

FIG. 2 illustrates a modification of the regenerating apparatus as previously described with reference to FIG. 1. All elements of this modified apparatus which are equal or similar to those of the apparatus according to FIG. 1 are also designated by the same reference numerals as in FIG. 1. The operation of the solenoid valves 14 to 16 of the apparatus according to FIG. 2 is controlled solely by the measuring device 30 which is responsive to the specific gravity of the etching medium 5 and causes the solenoid valves 14, 15 and 16 to be opened and thus the treating liquids 11, 12 and 13 to be supplied to the reaction container 1 as soon as the specific gravity of the etching medium 5 exceeds a certain maximum value. As soon as the pH-value of the etching medium 5 has dropped below a certain minimum, the measuring electrode 29 opens the solenoid valve 33 which is additionally connected to the supply container 8 and inserted into a line 32, and it closes the solenoid valve 15 which is connected to the supply container 9. As soon as the etching medium 5 has again the proper specific gravity and also the proper pH-value, the solenoid valves 14 to 16 and 33 are again closed.

Figure 3:
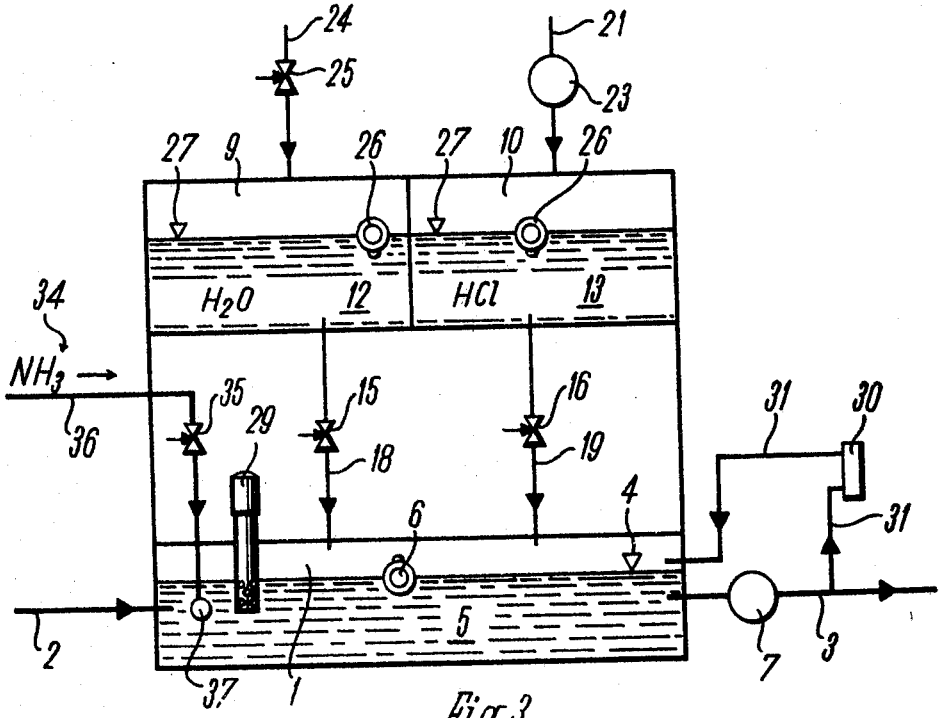
FIG. 3 is a diagrammatic illustration of another regenerating apparatus according to the invention, in which the regeneration of the etching medium is carried out by means of $NH_3$ gas, HCl and $H_2$)

The regenerating apparatus as illustrated in FIG. 3 differs from the apparatus according to FIG. 2 by employing ammonia gas instead of ammonium hydroxide 11 for the regeneration of the etching medium 5. This ammonia gas 35 is supplied from a container, not shown, through a gas line 36 which may be shut off by a solenoid valve 35 and through an injector 37 which is mounted within the reaction container 1. This regenerating apparatus therefore only requires the two supply containers 9 and 10 for the water 12 and the hydrochloric acid 13. All other parts of this apparatus may again be the same as those of the apparatus according to FIG. 2 and are therefore designated by the same reference numerals.

It is thus apparent from FIG. 3, that also in this embodiment of the invention the addition of the water 12 and also of the hydrochloric acid 13 will be controlled by the specific-gravity measuring device 30 which acts upon the solenoid valves 15 and 16. The addition of the ammonia gas 34 occurs, however, entirely independently of the specific-gravity measuring device 30 and solely by a pH-governor 38 which, as separately illustrated in FIG. 7 and subsequently described in detail, acts upon the solenoid valve 35 which is connected into the gas line 36.

Figure 4:
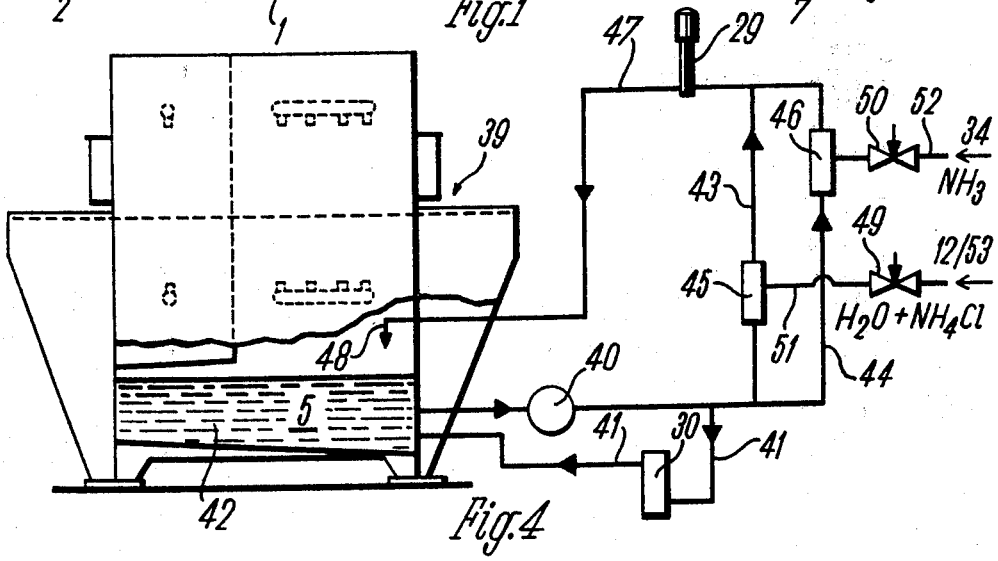
FIG. 4 is a diagrammatic illustration of an apparatus for regenerating the etching medium within the etching machine.

FIG. 4 illustrates a further embodiment of the invention, in which the regeneration of the etching medium 5 occurs directly within the etching machine 39 and in which a conduit 41 into which the specific-gravity measuring device 30 and a circulating pump 40 are inserted is connected directly to the container 42 of the etching medium 5 which forms a part of this machine 39. Two branch lines 43 and 44 are connected to the conduit 41 and each of these branch lines contains an injector 45 or 46, respectively. Subsequent to these injectors, the two branch lines 43 and 44 are connected to each other and to a common return line 47 to which the pH-value electrode 29 is connected. The end 48 of this return line 47 is connected to the etching machine 39 and terminates above the container 42 of the etching medium 5. The two injectors 45 and 46 are further connected to the two supply lines 51 and 52, which may be individually shut off by a solenoid valve 49 or 50, respectively. The supply line 51 leads to a supply container, not shown, from which ammonium chloride 53 which is dissolved in water 12 may be supplied, while the other supply line 52 leads to a supply container, not shown, from which ammonia gas 53 may be supplied. The addition of the ammonium chloride 53, for example, in the form of a solution of 168g per liter of water, is then controlled by the valve 49 which is actuated by the specific-gravity measuring device 30, while the addition of the ammonia gas 34 is controlled by the valve 50 which is actuated by the pH-value electrode 29.

This embodiment of the invention as illustrated in FIG. 4 is especially suitable for smaller etching machines 39 because of its very simple and inexpensive construction.

Figure 5:
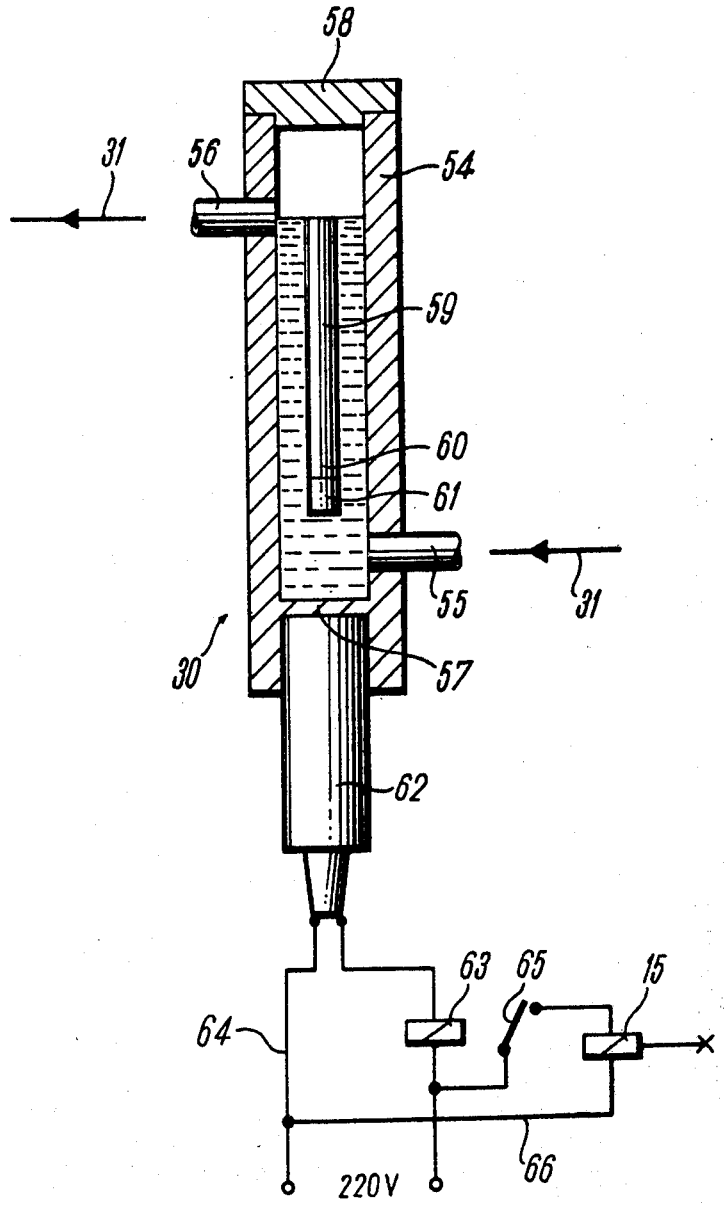
FIGS. 5 to 7 are diagrammatic illustrations of three different devices for measuring the specific gravity of the etching medium.

FIG. 5 illustrates on an enlarged scale the specific-gravity measuring device 30 for controlling the addition of water 12. It comprises a cylindrical container 54 which is provided near its opposite ends with an inlet 55 and an outlet 56. At the inside of this cylindrical container 54 which is closed by a bottom 57 and a cover 58 a rod-shaped float 59 is provided the lower end 60 of which carries a metallic extension 61 which consists of titanium and is operatively associated with an inductive switch 62 which is mounted on the container 54 underneath its bottom 57.

The entire rod-shaped float 59 has such a total weight that it will be suspended within the etching medium 5 of the container 54 when the etching medium has the desired specific gravity. If the specific gravity of the etching medium 5 rises, the float 59 likewise rises so that the distance increases between the metallic extension 61 and the inductive switch 62 and the latter opens a circuit 64 which contains a relay 63. When the relay 63 is thus switched off, the contact 65 of this relay will be moved to its normal closed position so that a secondary circuit 66 will likewise be closed which is connected in parallel to the circuit 64 and contains the solenoid valve 15 which controls the addition of water from the supply container 9 to the etching medium 5. The addition of the water from the container 9 will reduce the specific gravity of the etching medium 5 so that the float 59 will sink to a lower level and its metallic extension 61 will act upon the inductive switch 62 which will then close the primary circuit 64 so that the relay 63 will be energized and its contact 65 and thus also the secondary circuit 66 will thereby be opened. The opening of this circuit 66 then causes the solenoid valve 15 to be closed so that no more water will be added to the etching medium 5.

Figure 6:
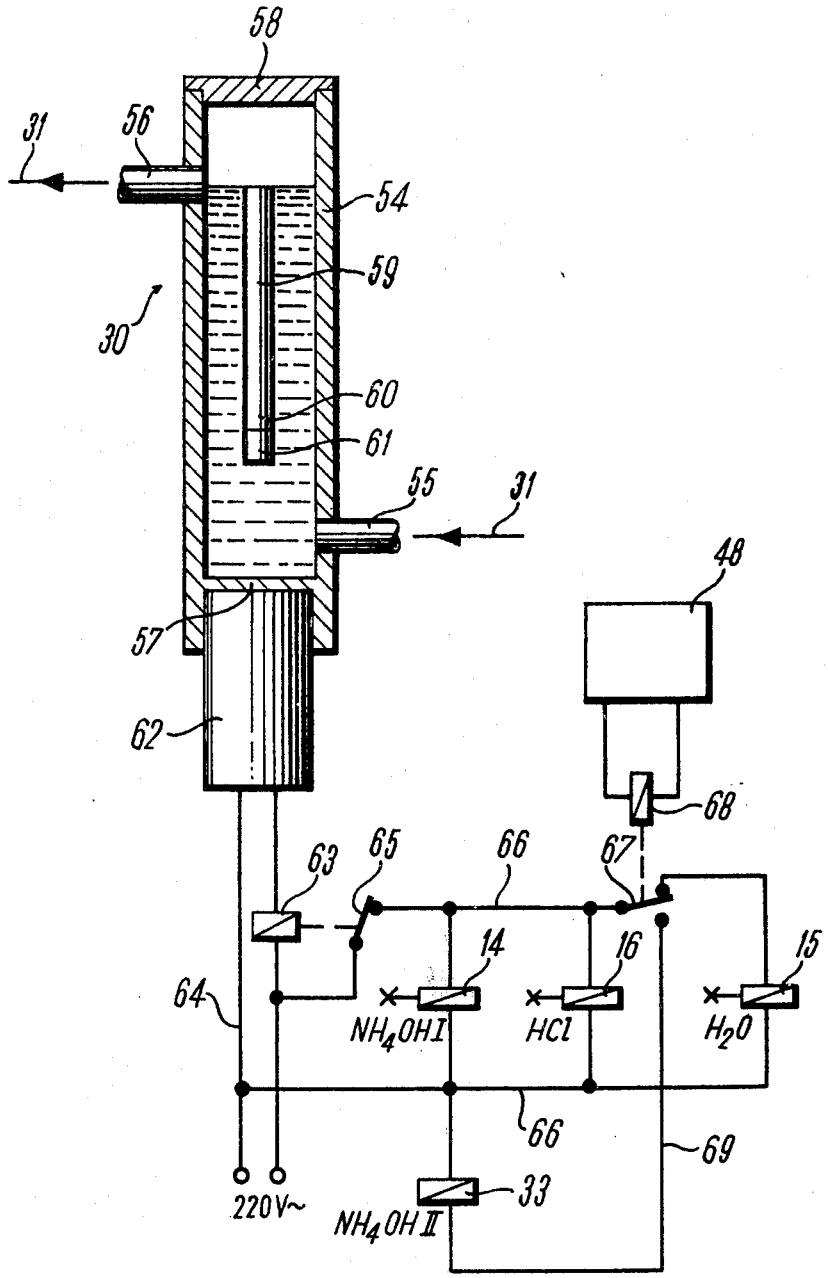

FIG. 6 illustrates the same specific-gravity measuring device 30 as shown in FIG. 5 which is likewise especially suitable for being used for the operation of the apparatus as shown in FIG. 2, but in a manner so as to attain results different from those as previously described with reference to FIG. 5. Insofar as the elements of the apparatus as shown in FIG. 6 are the same as those shown in FIG. 5, they are also designated by the same reference numerals. It also applies in this case that, when the float 59 rises in the cylindrical container 54, the inductive switch 62 will open the primary circuit 64 so that the relay 63 will be deenergized and its contact 65 will be closed which lies within the secondary circuit 66 which also contains the solenoid valves 14, 15 and 16 which regulate the supply of the regenerating liquids 11, 12 and 13 from the containers 8, 9 and 10 to the etching medium 5. The supply of these liquids will then lower the specific gravity of the etching medium 5 so that the float 59 will again sink within the cylindrical container 54 and actuate the inductive switch so as to close the primary circuit 64. The current flowing through this circuit will then again energize the relay 63 which will open the contact 65 and thus also the secondary circuit 66. This opening of the circuit 66 again causes the solenoid valves 14, 15 and 16 to be closed so that no further liquid will be added to the etching medium 5.

The secondary circuit 66 further contains a change-over switch 67 which is actuated by a relay 68 by means of the pH-governor 38 which has already been mentioned previously with reference to FIG. 3. If the pH-value of the etching medium 5 drops below a certain minimum limit and the pH governor 38 then switches on the relay 68, this will cause the change-over switch 67 to be shifted so that the solenoid valve 15 which regulates the addition of water will be closed and the solenoid valve 33 which regulates the addition of ammonium hydroxide will be opened via the branch line 69.

Figure 7:
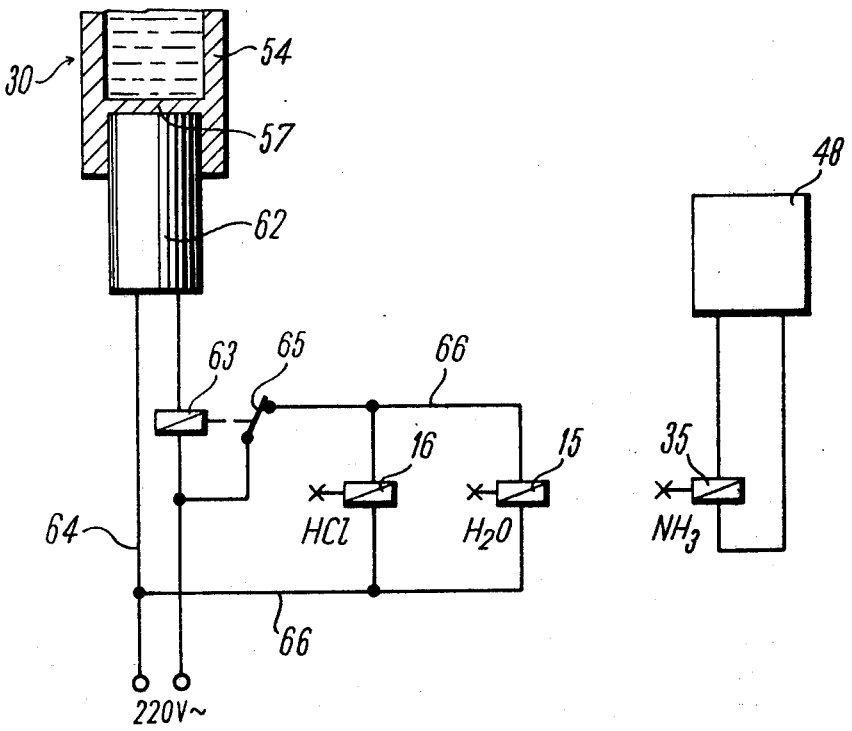

FIG. 7 illustrates the specific-gravity measuring device 30 which is connected to an electric circuit which is especially suitable for the operation of the apparatus as shown in FIG. 3 which is supplied with ammonia gas instead of ammonium hydroxide. This circuit is designed so that only the addition of the water 12 and the hydrochloric acid 13 will be controlled by the action of the measuring device 30 upon the solenoid valves 15 and 16. The supply of the ammonia gas 34 is, however, effected independently of the specific-gravity measuring device 30 and solely by the pH governor 38 which acts upon the solenoid valve 35 which is mounted within the gas line 36.

Figure 8:
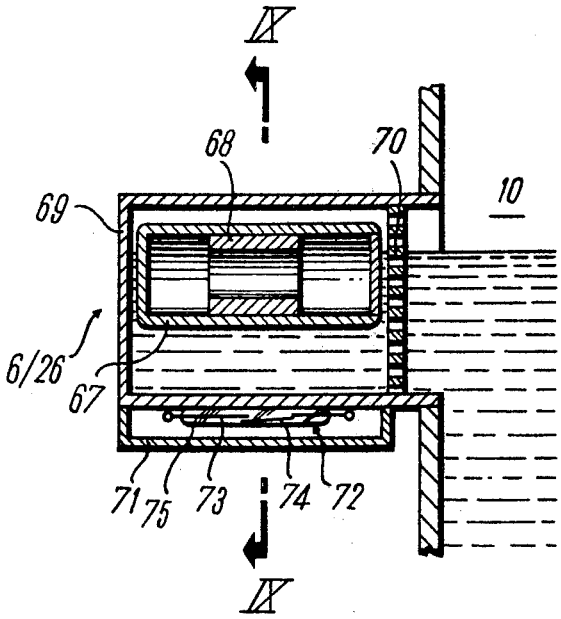
FIG. 8 is a diagrammatic illustration of a levelcontaining switch.
Figure 9:
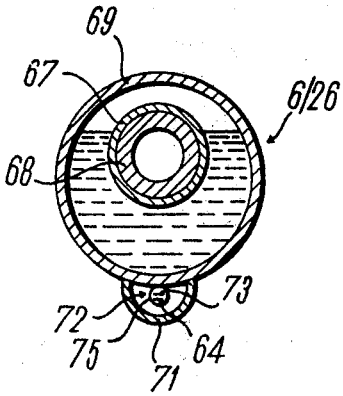
FIG. 9 is a cross section which is taken along the line IX — IX in FIG. 8.

The two further drawings, FIGS. 8 and 9, illustrate one of the level-control switches 6 or 26 which have been previously mentioned especially with reference to FIG. 1. This switch comprises a float 67 in which an annular segment 68 is mounted and which, in turn, is disposed within a housing 69 which is connected to one of the containers 1 and 8 to 10. A disk 70 which is provided with a series of apertures and is fitted tightly into the open end of the housing 69 prevents the float 67 from leaving this housing. In a trough-shaped container 71 with closed opposite ends which is secured to the lower side of the housing 69 an electric switch element 72 is mounted which consists of two contactor tongues 73 and 74 which are contained within a closed glass tube 75 the ends of which are fused tightly around the outer ends of these tongues. If, for example, the level 27 of the hydrochloric acid 13 sinks within the container 10, the float 67 will sink accordingly within the housing 69 so that the distance between the annular magnet 68 and the contactor tongues 73 and 74 will diminish and the movable tongue 74 will be drawn by the magnet 68 against the other tongue 73 and thereby close the electric contact between both tongues so that the pump 23 will be started and additional hydrochloric acid will be supplied to the container 10.

It has also been previously mentioned with reference to the apparatus as shown in FIG. 1 that this apparatus contains equal level-control switches 6 and 26 also in the two other supply containers 8 and 9 as well as in the reaction container 1. Depending upon whether a minimum level is to be controlled as in the supply containers 3, 9 and 10 or a maximum level as in the reaction container 1, the electric switch element 72 is to be mounted either below or above the housing 69.

When carrying out the method according to the invention in one of the apparatus as illustrated in FIGS. 1 to 3, the etching medium 5 is at first filled into the reaction container 1 and supplied by the feed pump 7 through the conduit 3 to the etching machine, not shown.

During the following etching process, the quantity of etching medium 5 increases due to the required additions of the regenerating media 11 to 13 so that the level of the etching medium 5 rises accordingly in the reaction container 1. As soon as in the apparatus according to FIG. 1 the etching medium 5 reaches the maximum level 4 in the reaction container 1 or as soon as the concentration of copper reaches the maximum value of about 150 g per liter of etching medium 5 at which an undesirable recrystallization may start, a part of the etching medium 5 is drained off and, in the latter case, the remainder of the etching medium 5 is diluted by the addition of water 12 so as to regain the original concentration of about 40 g of copper per liter of etching medium. The regeneration of the etching medium 5 occurs, however, independently of this dilution and it is controlled by the two measuring electrodes 28 and 29 in the manner as previously described. If this control is to be carried out automatically, the above-mentioned measuring device 30 should be employed for maintaining the copper concentration substantially constant.

If, however, in the operation of the apparatus as shown in FIG. 2 the etching medium 5 in the reaction container exceeds the maximum level 4, the etching medium will be drained off until the remainder has gained the original level 4. The addition of the regenerating media 11 to 13 occurs in accordance with and in response to the measurement of the specific gravity of the etching medium which is carried out by the measuring device 30. A further correction of the composition of the etching medium may be carried out by means of the pH governor 38 which effects either an addition of water 12 through the line 18 or of a further amount of ammonium hydroxide 11 through the line 32 depending upon the pH-value which the etching medium may have at the particular time.

In the third embodiment of the regenerating apparatus according to the invention as illustrated in FIGS. 3 and 7, however, the water 12 and the hydrochloric acid 13 are added to the etching medium 5 in accordance with the measurements of the specific gravity of the latter which are carried out by the measuring device 30, while the addition of the ammonia gas 34 is effected solely by the pH governor 38.

Regarding the regeneration of the etching medium 5 within the etching machine 39 as illustrated in FIG. 4, it may further be mentioned that the quantity of the solution of ammonium chloride in water 12 which will be added to the etching medium 5 depends upon the specific gravity of the latter while the quantity of the addition of the ammonia gas depends upon the pH-value of the etching medium 5.

Apart from the fact that the method as well as the regenerating apparatus according to the invention permit the etching medium 5 to be regenerated continuously and its etching power to be maintained at a constant value, the invention also permits the etching process to be carried out at a constant temperature of about 35° to 37°C. and a pH-value of about 8.6 to 10.0. The etching factor will then amount to about 23 to 24 $\mu$m/min. so that the etching period for 35$\mu$m will amount to about 90 seconds.

Although my invention has been illustrated and described with reference to the preferred embodiments thereof, I wish to have it understood that it is in no way limited to the details of such embodiments but is capable of numerous modifications within the scope of the appended claims.

Having thus fully disclosed by invention, what I claim is:

1. A method of etching copper and copper alloys, comprising:

forming an etching medium consisting of an ammoniacal etching solution containing chloride ions, thereby producing a copper-I compound;

regenerating the copper-I compound formed during the etching process by reacting therewith a chloro compound selected from the group which consists of HCl, ammonium chloride and NaCl only during the etching process by the addition of the chloro compound to said solution at a rate corresponding to the rate of formation of said copper-I compound; and supplying to said solution an amount of an ammoniacal compound selected from the group which consists of ammonium hydroxide and ammonia gas such that the pH-value of the latter is maintained at about 8.5 to 10.0, the copper content per liter of etching medium being maintained at a substantially constant value by the addition of water, the addition of the chloro compound to the etching medium to be regenerated being controlled in dependence upon the redox potential of the etching medium, while the molar ratio of the chloro compound to the ammoniacal compound amounts substantially to 1 to 2.

2. A method as defined in claim 1, in which the ammoniacal compound consists of ammonia gas.

3. A method as defined in claim 1, in which the addition of the ammoniacal compound is controlled in dependence upon the pH-value of the etching medium.

* * * * *